United States Patent [19]

Laurello

[11] Patent Number: 4,553,901

[45] Date of Patent: Nov. 19, 1985

[54] STATOR STRUCTURE FOR A GAS TURBINE ENGINE

[75] Inventor: Vincent P. Laurello, Guilford, Conn.

[73] Assignee: United Technologies Corporation, Hartford, Conn.

[21] Appl. No.: 564,431

[22] Filed: Dec. 21, 1983

[51] Int. Cl.[4] ..... F01D 25/28

[52] U.S. Cl. ..... 415/138; 415/139; 415/170 R; 60/39.07; 60/39.75

[58] Field of Search ..... 60/226.1, 39.75, 39.07, 60/266, 262; 415/170 R, 115, 116, 178, 175, 177, 134, 136, 138, 139

[56] References Cited

U.S. PATENT DOCUMENTS

| | | | |
|---|---|---|---|
| 3,443,791 | 5/1969 | Sevetz et al. | 415/115 |
| 3,656,862 | 4/1972 | Rahaim et al. | 415/171 |
| 3,742,705 | 2/1973 | Sifford | 415/115 X |
| 3,800,864 | 4/1974 | Hauser et al. | 415/115 X |
| 3,807,891 | 4/1974 | McDow et al. | 415/116 |
| 3,966,352 | 6/1976 | White et al. | 415/115 |
| 3,972,181 | 8/1976 | Swayne | 415/116 X |
| 4,019,320 | 4/1977 | Redinger, Jr. et al. | 415/116 X |
| 4,023,919 | 5/1977 | Patterson | 415/178 X |
| 4,101,242 | 7/1978 | Coplin et al. | 415/134 |
| 4,217,755 | 8/1980 | Williams | 415/116 X |
| 4,230,436 | 10/1980 | Davison | 415/175 X |
| 4,279,123 | 7/1981 | Griffin et al. | 60/226.1 |
| 4,314,791 | 2/1982 | Weiler | 415/115 |
| 4,337,016 | 6/1982 | Chaplin | 415/116 |
| 4,363,599 | 12/1982 | Cline et al. | 415/178 X |

*Primary Examiner*—Carlton R. Croyle
*Assistant Examiner*—Jeffrey A. Simenauer
*Attorney, Agent, or Firm*—Gene D. Fleischhauer

[57] ABSTRACT

A stator structure 88 for supporting a pair of outer air seals 62, 72 and an array of stator vanes 82 from two axial locations $A_1$, $A_2$ on a coolable outer case is disclosed. Various construction details which enable the structure to respond to the movement of coolable rails are disclosed. In one embodiment, a pair of support rings 96, 100 and a pair of support rings 122, 124 extend between the outer case and the outer air seal and array of stator vanes 82.

10 Claims, 4 Drawing Figures

STATOR STRUCTURE FOR A GAS TURBINE ENGINE

DESCRIPTION

1. Technical Field

This invention relates to gas turbine engines and more particularly to a stator structure for supporting a pair of outer air seals and an array of stator vanes in such an engine. The concepts of the present invention were developed in the field of axial flow gas turbine engines and have application to stator structures in other fields.

2. Background Art

An axial flow gas turbine engine generally includes a compression section, a combustion section and a turbine section. A rotor extends axially through the sections of the engine. A stator extends axially to circumscribe the rotor. An annular flow path for hot, working medium gases extends through the engine between the rotor and the stator. As the gases are flowed through the engine, the gases are compressed in the compression section, burned with fuel in the combustion section and expanded through the turbine section to produce useful work.

The rotor in the turbine section has a rotor assembly for extracting useful work from the hot, pressurized gases. The rotor assembly includes a first rotor disk and blade assembly and a second rotor disk and blade assembly spaced axially from the first assembly. The rotor blades extend radially outwardly from the disks across the annular flow path for working medium gases into proximity with the stator. A rotor structure extends axially between the two assemblies to bound the inner diameter of the annulur flow path.

The stator includes sealing elements for blocking the leakage of working medium gases from the annular flow path. An outer case and a stator structure for supporting and positioning the sealing elements extends axially through the engine. The sealing elements include a first outer air seal and a second outer air seal. Each outer air seal extends circumferentially about an associated array of rotor blades to block the leakage of working medium gases over the tips of the blades. An array of stator vanes extends inwardly across the working medium flow path and between the arrays of outer air seals into proximity with the rotor structure. The array of stator vanes has a seal land at the inner diameter of the working medium flow path for blocking the leakage of working medium gases over the tips of the stator vanes. The outer air seal and the seal land of the array of stator vanes are spaced radially from the rotor structure leaving a clearance gap therebetween. The clearance gap is provided to avoid destructive interference between the rotor blades and the outer air seals.

In modern engines, the clearance gap between the rotor blades and the outer air seal is modulated to minimize the clearance during various operating conditions of the engine. Examples of engines employing a coolable outer case to modulate the tip clearance are shown in U.S. Pat. No. 4,019,320 issued to Redinger et al. entitled "External Gas Turbine Engine Cooling For Clearance Control" and U.S. Pat. No. 4,247,248 issued to Chaplin et al. entitled "Outer Air Seal Support Structure For A Gas Turbine Engine," the material in which is incorporated herein by reference. As shown in these patents, the outer case is attached to the outer air seals and the seal land of the stator vanes so that selective cooling of the outer case changes the diameter of the outer case and causes a similar change in the diameter of the seals. The seals are segmented to enable the seal to accommodate the changes in diameter. As the diameter of the outer air seal grows smaller, the clearance gap grows smaller; as the diameter grows larger, the clearance gap grows larger.

As shown in Redinger and Chaplin, each outer air seal is provided with a stator support structure that includes a segmented upstream support ring and a segmented downstream support ring. The engine case has a first circumferentially extending rail adjacent to the upstream support ring of the first outer air seal and a second circumferentially extending rail adjacent to the downstream support ring. At the second outer air seal, a third circumferentially extending rail is adjacent to the upstream support ring and a fourth circumferentially extending rail is adjacent to the downstream support ring.

During operation, cooling air is impinged on the external rails. As the cooling air carries heat away from the external rails, the external rails contract and force the internal support structure to a smaller diameter. The internal support structure is circumferentially slidable with respect to the outer case and the outer air seal segments to accommodate the large changes in diameter. Turning off the cooling air allows the rail to expand with a concomitant increase in the diameter of the internal support structure and the outer air seal increasing the radial clearance gap between the sealing elements and the rotor structure.

The cooling air that is impinged on the coolable rails is pressurized to an extent that enables the air to flow from spray bars to the rail. One source of pressurized cooling air is the compression section of the engine. As the working medium gases are passed through the fan section, a portion of the pressurized gases (air) is removed from the working medium flow path and ducted to the spray bars. Because the cooling air is removed from the working medium flow path after energy is expended by engine to pressurize the gases, it is desirable to reduce the amount of cooling air needed for clearance control. In addition, the many parts required to support the outer air seals and array of stator vanes increases the cost of the engine although the cost is far outweighed by the performance benefit and fuel saving that is gained by clearance control.

Accordingly, scientists and engineers are searching for ways to decrease the need for pressurized cooling air and to simplify the construction of the stator structure for supporting the outer air seals and stator vanes to increase the efficiency of the engine and to decrease the cost of fabricating the engine.

DISCLOSURE OF INVENTION

According to the present invention, a stator assembly for the turbine section of a gas turbine engine having two segmented outer air seals and an array of stator vanes extending therebetween has a first support radially attached to the outer case at a first axial location and a second support radially attached to the outer case at a second axial location to radially support and position the outer air seals and vanes about a rotor structure.

In accordance with one embodiment of the present invention, the outer case includes a first coolable rail for radially positioning the first axial location and a second coolable rail for radially positioning the second axial location.

A primary feature of the present invention is a gas turbine engine having two segmented outer air seals and an array of stator vanes extending axially therebetween. The outer air seals and the array of stator vanes are spaced radially from a rotor assembly leaving clearance gaps therebetween. Another feature is a coolable outer case having a first axial location and a second axial location. A stator structure attached to the outer case at these two locations has a first support means for supporting the upstream end of the vanes and one of the segmented outer air seals and has a second support means for supporting the downstream end of the vanes and the other segmented outer air seal. Both the first support means and the second support means slidably engage in the circumferential direction the segments of the outer air seal and trap the segments in the axial and radial directions. In one embodiment, a first coolable rail extends circumferentially about the case to radially position the case at the first location and a second coolable rail radially positions the case at the second location. In one embodiment, a first flange extends inwardly from the outer case and is attached to the outer case at the first location for attaching the first support means to the outer case. A second flange extends inwardly from the outer case and is attached to the outer case at the second location for attaching the second support means to the outer case.

A principle advantage of the present invention is the efficiency of a gas turbine engine employing a coolable outer case having two support points for clearance control which results from the amount of cooling air needed to position the two outer air seals and the array of stator vanes. Another principle advantage is the cost and weight of the engine in comparison to engines using two individual support points at each outer air seal which results from avoiding two separate sets of hardware and attachment points for each outer air seal. An advantage is the engine efficiency which results from attaching the upstream and downstream supports of an outer air seal to the outer case at the same axial location causing the supports to move by the same radial amount to avoid tilting of the segments from front to rear. In one embodiment, reduced costs result from fabricating an outer case with two internal flanges for supporting both the outer air seals and the array of stator vanes as compared with an outer case which employs four flanges for supporting both the outer air seals and the stator vanes. In one embodiment, an advantage is the amount of cooling air required to position two external rails as compared to constructions employing four rails.

The foregoing features and advantages of the present invention will become more apparent in the light of the following detailed description of the best mode for carrying out the invention and the accompanying drawings.

BEST MODE FOR CARRYING OUT THE INVENTION

Figure 1:
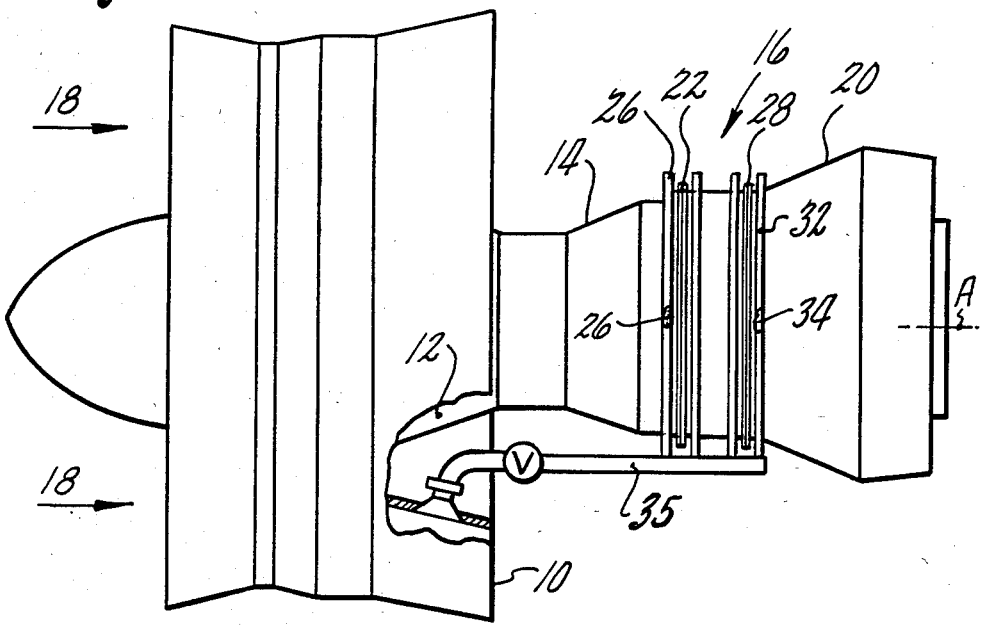
FIG. 1 is a side elevation view of a turbofan engine with a portion of the fan case broken away to show a cooling air duct.

FIG. 1 shows a turbofan, axial flow gas turbine engine embodiment of the invention. The engine includes a fan section 10, a compression section 12, a combustion section 14 and a turbine section 16. The engine has an axis of rotation A and an annular flow path 18 for working medium gases which extends axially through these sections of the engine. A coolable outer case 20 extends circumferentially about the working medium flow path. The outer case in the turbine section of the engine has a first coolable rail 22 integral with the outer case which extends circumferentially about the exterior of the engine. A first means for flowing cooling air to the coolable outer case, such as the spray bar 24, extends circumferentially about the exterior of the case. The center portion of the spray bar is broken away to show the first coolable rail. A multiplicity of cooling air holes 26 places the interior of the bar in flow communication with the first rail. A second coolable rail 28 is spaced axially from the first coolable rail and is integral with the outer case. The second coolable rail extends circumferentially about the exterior of the engine. A second means for flowing cooling air to the ccolable outer case, such as the spray bar 32, extends circumferentially about the exterior of the engine. The center portion of the spray bar is broken away to show the second coolable rail. A multiplicity of cooling air holes 34 places the interior of each bar in flow communication with the second rail. A duct 35 for cooling air extends rearwardly from the fan section of the engine. The duct is in flow communication with the spray bars to provide a source of cooling air to the coolable rails.

Figure 2:
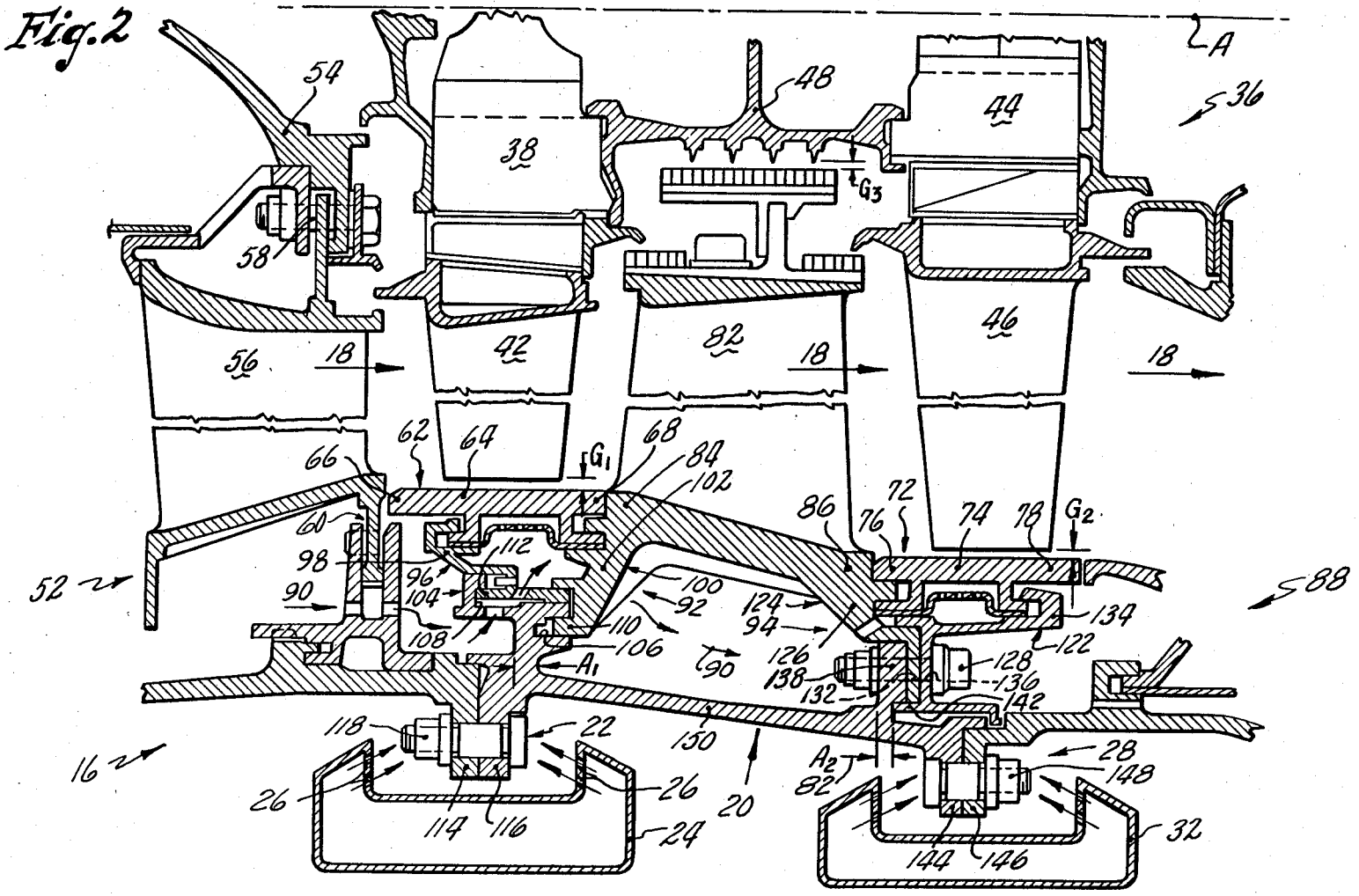
FIG. 2 is a cross-sectional view of a portion of the turbine section of the engine.

FIG. 2 is a cross-sectional view of a portion of the turbine section 16 of the engine showing part of the coolable outer case 20 and the annular flow path 18 for hot working medium gases. The turbine section has a rotor assembly 36 rotatable about the axis of rotation A. The rotor assembly includes a first rotor disk 38 and a first array of rotor blades, as represented by the single rotor blade 42, which extend outwardly from the rotor disk across the working medium flow path. A second rotor disk 44 is spaced axially from the first rotor disk. A second array of rotor blades, as represented by the single rotor blade 46, extends outwardly from the second rotor disk across the working medium flow path. An inner air seal 48 extends axially between the disks and is trapped radially by the disks.

The turbine section 16 includes a stator assembly 52. The stator assembly includes an inner case 54 extending circumferentially about the axis A and the coolable outer case 20 which extends circumferentially about the axis A engine to form the exterior of the engine. An array of stator vanes, as represented by the single stator vane 56, extends radially between the inner case and the outer case. A plurality of pins, as represented by the single bolt 58, engage the array of stator vanes to restrain the array of stator vanes against radial movement. Each stator vane engages the outer case at a spline-type connection 60 to slidably engage the outer case in the radial direction.

A first outer air seal 62 extends circumferentially about the first array of rotor blades 42 and is spaced radially from the rotor blades leaving a radial clearance gap $G_1$ therebetween. The outer air seal is formed of an array of arcuate seal segments, as represented by the single seal segment 64. Each seal segment has an upstream end 66 and a downstream end 68.

A second outer air seal 72 is spaced axially from the first outer air seal 62. The second outer air seal extends circumferentially about the second array of rotor blades and is spaced radially from the second array of rotor blades leaving a radial clearance gap $G_2$ therebetween. The second outer air seal is formed of an array of arcuate seal segments, as represented by the single seal segment 74. Each seal segment has an upstream end 76 and a downstream end 78.

A second array of stator vanes extends axially between the first and second outer air seals, as represented by the single stator vane 82. The second stator vane extends radially inwardly across the working medium flow path between the first rotor blade 42 and the second rotor blade 46. Each vane extends into proximity with the inner air seal 48 leaving a radial gap $G_3$ therebetween. Each vane has an upstream end 84 and a downstream end 86.

A stator structure 88 provides a means for supporting and positioning the outer air seals 62, 72 and the array of stator vanes 82 to regulate the clearance gaps $G_1$, $G_2$ and $G_3$. The stator structure includes the coolable outer case 20 which extends circumferentially about the engine. The coolable outer case is spaced radially from the outer air seals and vanes leaving a flow path 90 for cooling air therebetween. A first means 92 for supporting the upstream end 84 of the array of stator vanes 82 and the first array of outer air seal segments 64 extends inwardly from the outer case across the flow path for cooling air. The first support means is attached to the outer case at a first axial location $A_1$. A second means 94 for supporting the downstream end 86 of the array of stator vanes and the second array of outer air seal segments extends inwardly from the outer case across the flow path for cooling air. The second support means is attached to the outer case at a second axial location $A_2$.

The first support means 92 includes an upstream support ring 96 having a plurality of arcuate segments 98. A downstream support ring 100 has a frustoconical shape for rigidity and is formed of a plurality of downstream support segments, as represented by the single downstream support segment 102. Each downstream support segment is integral with at least one of the stator vanes 82. Each downstream support segment engages the downstream end 68 of a segment 64 of the first outer air seal 62 and is circumferentially slidable with respect to the segments of the outer air seal. Each downstream support segment traps the associated seal segment in the axial direction and radially positions the downstream end of the outer air seal. Each downstream support segment extends from the outer air seal to the outer case 20 and slidably engages the outer case in the circumferential direction.

The upstream support ring 96 is frustoconical in shape for rigidity. Each upstream support segment 98 is trapped by the outer case 20 and an associated downstream support segment 102. Each upstream support segment slidably engages the outer case and extends from the outer case to the outer air seal to engage the outer air seal. Each upstream support segment is circumferentially slidable with respect to outer air seal. Each upstream support segment traps the upstream end 66 of an associated arcuate seal segment of the outer air seal in the axial direction and radially positions the end of the seal segment.

A first flange 104 is attached to the outer case 20 at the first location $A_1$. The first flange extends inwardly from the outer case to radially attach and slidably engage in the circumferential direction the segments of at least one of the support rings to radially attach the segments of both support rings to the outer case. In the embodiment shown, the first flange has a first groove 106 and a second groove 108. A first rib 110 on the downstream support segment 102 engages the first groove 106. A second rib 112 on the upstream support segment engages the second groove 108.

The first coolable rail 22 for radially positioning the outer case 20 at the first axial location $A_1$ extends circumferentially about the exterior of the outer case. The outer case has an upstream flange 114 and a downstream flange 116 at the first coolable rail. A plurality of circumferentially spaced nut and bolt combinations 118 join the flanges to form a first casing joint at the first coolable rail. As shown, the first means for flowing cooling air 24 is in fluid communication with the rail and is adapted by the holes 26 to impinge cooling air on the coolable rail.

The second support means 94 includes a downstream support ring 122 and an upstream support ring 124. The upstream support ring is formed of a plurality of upstream support segments, as represented by the single upstream support segment 126. Each upstream support segment is integral with at least one downstream end 86 of the stator vane of the array of stator vanes 82. Each upstream support segment engages an associated segment 74 of the second outer air seal 72 and is circumferentially slidable with respect to the outer air seal trapping the seal segments in the axial direction and radially positioning the seal segments about the array of rotor blades. Each upstream support segment extends from the outer air seal to the outer case 20 and slidably engages the outer case in the circumferential direction. In the embodiment shown, a nut and bolt combination 128 extends through the downstream support segment to fix the downstream support segment to the outer case. The upstream support segment is adapted by a hole 132 to receive the nut and bolt combination. The bolt prevents the upstream support segment from shifting circumferentially with respect to the case. Nevertheless, the remaining portion of the segment is free to move circumferentially with respect to the case. Thus the support segment is circumferentially slidable with respect to the outer air seal and the outer case.

The downstream support ring 122 is formed of a plurality of downstream support segments 134 which engage the segments of the outer air seal to trap the second seal segments in the axial direction and to radially position the outer air seal segments. Each of the downstream support segments is adapted by a hole 136 to receive the nut and bolt combination 128 which urges the downstream support segment against the upstream support segment. As with the upstream support segment, the downstream support segment is circumferentially slidable with respect to the outer case although a portion of the segment is restrained from shifting circumferentially with respect to the case. Nevertheless at least one end of each segment is free to move circumferentially. Thus the support segment is circumferentially slidable with respect to the outer air seal and the outer case.

A second flange 138 extends inwardly from the outer case to radially attach and slidably engage in the circumferential direction the segments 126 of the upstream support ring 124. The downstream support segment is attached to the flange by the nut and bolt combination 128. In the embodiment shown, the downstream support segment has a flange 142 which engages the second flange 138.

The second coolable rail 28 for radially positioning the outer case at the first axial position extends circumferentially about the outer case 20. The case has an upstream flange 144 and a downstream flange 146. The upstream and downstream flanges are joined together by a plurality of circumferentially spaced nut and bolt combinations 148 which cause the second rail to be integral with the outer case at a second flanged casing joint. An axially continuous casing member 150 extends between the first flange joint and the second flange point. The term "axially continuous" means the element 150 is uninterrupted by joints formed by circumferentially extending flanges.

Figure 3:
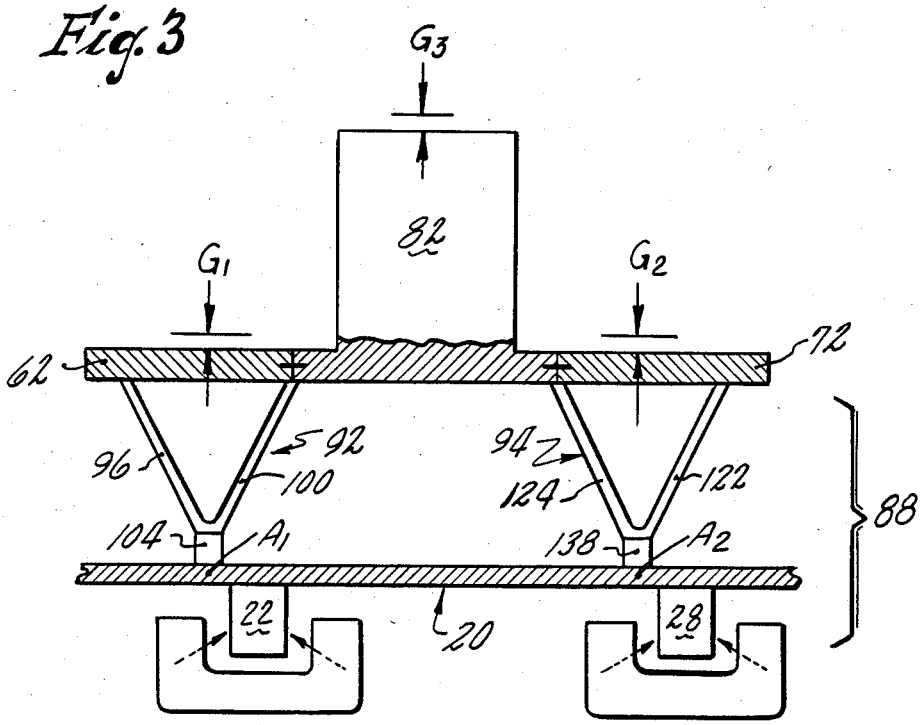
FIG. 3 is a schematic representation of a portion of the stator assembly shown in FIG. 2.

FIG. 3 is a schematic representation of a portion of the stator assembly shown in FIG. 2 which illustrates the radial interrelationship of the parts. FIG. 3 does not show the circumferential relationship of the parts which permits slidable movement in the circumferential direction.

As discussed in the description of FIG. 2, the stator structure 88 provides a means for supporting and positioning the outer air seals 62, 72 and the array of stator vanes 82. The stator structure includes a coolable outer case 20 having a first coolable rail 22 for adjusting the diameter of the outer case at the first axial location $A_1$ and having a second coolable rail 28 for adjusting the diameter of the outer case at the second axial location $A_2$.

A first support means 92 and a second support means 94 extend inwardly from the outer case to position the outer air seals 62, 72 and the array of stator vanes 82. The first support means includes a first flange 104 at the first axial location, a segmented upstream support ring 96 and a segmented downstream support ring 100. The second support means includes a second flange 138 at the second axial location $A_2$ and a segmented upstream support ring 124 and a segmented downstream supporting ring 122.

The clearance gaps $G_1$, $G_2$ and $G_3$ between the stator assembly and the rotor assembly are shown illustrating the affect that two point attachment has on the radial positioning of the stator assembly about the rotor assembly.

Figure 4:
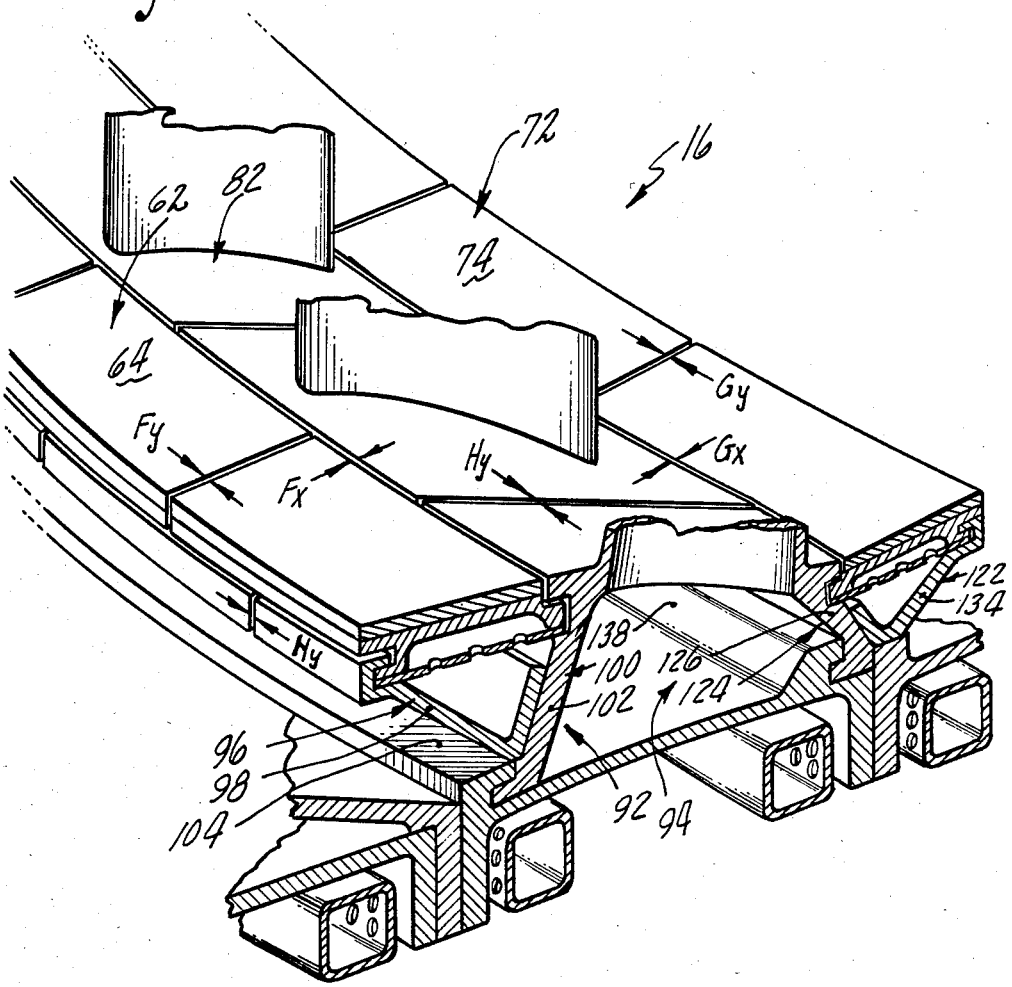
FIG. 4 is an alternate embodiment of a portion of the turbine section shown in FIG. 2.

FIG. 4 is a partial perspective view of an alternate embodiment of the turbine section 16 shown in FIG. 2. The same reference numerals are used to refer to like parts performing the same function as the parts shown in FIG. 2. In the alternate embodiment, the first support means 92 and the second support means 94 each have a segmented upstream support ring 96, 124 and a segmented downstream support ring 100, 122. Each segment of each upstream support ring is integral with an associated segment of the adjacent downstream support ring. For example, a segment 98 of the upstream support ring 96 and an associated segment 102 of the downstream support ring 100 might be bolted together, cast together, or, as shown, bonded together by a suitable process. Each segment 102 of the downstream support ring 100 is integral with an associated stator vane and each segment 126 of the upstream support ring 124 is integral with an associated stator vane such that each upstream support segment 98 is integral with an associated downstream support segment 134.

FIG. 4 shows the circumferential relationship of the segments which is not shown in FIG. 3. Each set of circumferentially slidable support segments and each set of circumferentially slidable air seal segments is spaced axially and circumferentially from the adjacent structure to accommodate the axial and circumferential movement that occurs as a result of the extraordinary temperatures of the turbine environment and the radial movement of the outer case. For example, each segment 64 of the first outer air seal 62 is spaced circumferentially from the adjacent segment by a circumferential gap Fy and axially from the adjacent vane segment by an axial gap Fx. Each segment 74 of the second outer air seal 72 is spaced circumferentially from the adjacent segment by a circumferential gap Gy and axially from the adjacent vane segment by an axial gap Gx. The segments 98 and 102 of the upstream support means 92 and the segments 126 and 134 of the downstream support means are spaced circumferentially by the gap Hy.

During operation of the gas turbine engine, hot working medium gases are flowed from the combustion section 14 to the turbine section 16. The hot, pressurized gases are expanded in the turbine section. As the gases are flowed along the annular flow path 18, heat is transferred from the gases to components in the turbine section. The arrays of rotor blades are bathed in the hot working medium gases and respond more quickly than does the outer case 20 which is more remote from the working medium flow path. An initial clearance is provided to accommodate the rapid expansion of the blades and the disks with respect to the case and the structure supported by the case, such as the outer air seals and the stator vanes. As a result, the radial gaps $G_1$, $G_2$, and $G_3$ between the rotor assembly and the stator assembly vary. As times passes, the outer case receives heat from the gases and expands away from the rotor blades increasing the size of the gaps $G_1$, $G_2$ and $G_3$.

The size of these gaps is regulated by impinging cooling air on the coolable rails. As the rails contract, the rails force the first axial location $A_1$ and the second axial location $A_2$ of the outer case to move inwardly causing the support rings of the first support means and the second support means to decrease in diameter moving the arcuate seal segments and the ends of the stator vanes to a smaller diameter. This movement decreases the size of the gaps $G_1$, $G_2$ and $G_3$.

The use of only two support points, one at the axial location $A_1$ and the other at the axial location $A_2$, permits a reduction in the number of parts for supporting the outer air seals and vanes as compared with constructions which require a separate set of hardware extending from each end of the outer air seal to a coolable rail on the outer case. The reduction in the number of parts for the support structure decreases the thermal capacitance of the support structure, decreases the ability of the support structure through friction to resist circumferential and radial movement of the case as the diameters of the axial locations are changed, and, decreases the number of leak paths for internal cooling air which is flowed along the flow path 90 between the outer air seal and the coolable case. As a result, using two support points to position the array of outer air seals and the vanes reduces the need for cooling air and is reflected by a gain in engine efficiency. In the construction shown, only two rails are used to position the outer case at the first axial location and the second axial location. The decrease in the number of rails, as compared with constructions which use a separate rail to position each end of an array of outer air seals, decreases the thermal capacitance of the overall structure and further reduces the need for cooling air.

Another advantage of the present construction is the cost and weight of the engine in comparison to engines using individual support points at the upstream and downstream ends of each outer air seal. The reduction in the number of parts reduces the overall cost of the structure. In addition, the outer case is much simpler to fabricate, requiring only two flanges for supporting the arrays of outer air seals as compared with constructions employing four internal flanges to support the outer air seals and vanes.

Although the invention has been shown and described with respect to detailed embodiments thereof, it should be understood by those skilled in the art that various changes in form and detail thereof may be made without departing from the spirit and the scope of the claimed invention.

I claim:

1. In an axial flow gas turbine engine having an annular flow path for working medium gases and a turbine section through which the working medium gases are passed, the turbine section having a rotor assembly which includes a first rotor disk and a first array of rotor blades extending outwardly from the disk across the working medium flow path, a second rotor disk and a second array of rotor blades extending outwardly from the disk across the working medium flow path, and an inner air seal extending between the disks, the turbine section further having a stator assembly which includes a first outer air seal composed of an array of arcuate segments extending circumferentially about the first array of rotor blades and spaced radially from the first rotor blades leaving a radial gap $G_1$ therebetween, a second outer air seal composed of an array of arcuate segments extending circumferentially about the second array of rotor blades and spaced radially from the second rotor blades leaving a radial gap $G_2$ therebetween, an array of stator vanes each of which has an upstream end and a downstream end, the vanes extending axially between the first and second outer air seals and extending radially inwardly across the working medium flow path between the first and second arrays of rotor blades into proximity with the inner seal leaving a radial gap $G_3$ the rebetween, and means for supporting and positioning the outer air seals and vanes to regulate the gaps $G_1$, $G_2$ and $G_3$ which includes a coolable outer case extending circumferentially about the engine, the improvement which comprises:

stator structure means for supporting and positioning the outer air seals and array of vanes from the outer case at only a first axial location and a second axial location on the outer case which includes first means for supporting the upstream end of the array of stator vanes and the first array of outer air seal segments which slidably engages each first segment in the circumferential direction and engages each first segment at two axially spaced locations to trap the first segments in the downstream direction and the upstream direction, the first means being attached to the outer case at one axial location, said location being said first axial location, second means for supporting the downstream end of the array of stator vanes and the second array of outer air seal segments which slidably engages each second segment in the circumferential direction and engages each second segment at two axially spaced locations to trap the second segments in the downstream direction and the upstream direction, the second means being attached to the outer case at one axial location, said location being said second axial location, first means for flowing cooling air to the coolable outer case to adjust the diameter of the outer case at the first axial location, and second means for flowing cooling air to the coolable outer case to adjust the diameter of the outer case at the second axial location, wherein movement of the outer case in the turbine section at the first axial location and the second axial location simultaneously adjusts the clearance gaps $G_1$, $G_2$ and $G_3$ from these two axial locations.

2. The stator structure for supporting and positioning the outer air seals and vanes of claim 1 which further includes a first coolable rail extending circumferentially about the exterior of the outer case for radially positioning the outer case at the first axial location and a second coolable rail extending circumferentially about the outer case for radially positioning the outer case at the second axial location, and wherein the first means for flowing cooling air is in flow communication with the first coolable rail and the second means for flowing cooling air is in flow communication with the second coolable rail.

3. The stator structure for supporting and positioning the outer air seals and vanes of claim 2 wherein the first support means includes a first flange extending inwardly from the outer case which is attached to the outer case at the first location, and wherein the second support means includes a second flange extending inwardly from the outer case which is attached to the outer case at the second location.

4. The stator structure for supporting and positioning the outer air seals and vanes of claim 1 wherein the first support means includes a first flange extending inwardly from the outer case which is attached to the outer case at the first location, and wherein the second support means includes a second flange extending inwardly from the outer case which is attached to the outer case at the second location.

5. The stator structure for supporting and positioning the outer air seals and vanes of claim 1 wherein each outer air seal has a first end and a second end, wherein one of said support means includes a first support ring formed of a plurality of upstream support segments which radially positions and slidably engages in the circumferential direction the first end of the outer air seal and a second support ring which radially positions and slidably engages in the circumferential direction the second end of the outer air seal.

6. The stator structure for positioning the outer air seals and stator vanes of claim 5 wherein the first ring engages the second ring and is circumferentially slidable with respect to the second ring.

7. The stator structure for positioning the outer air seals and stator vanes of claim 5 wherein each segment of the first ring engages and is integral with an associated segment of the second ring.

8. In an axial flow gas turbine engine having an annular flow path for working medium gases and a turbine section through which the working medium gases are passed, the turbine section having a rotor assembly which includes a first rotor disk and a first array of rotor blades extending outwardly from the disk across the working medium flow path, a second rotor disk and a second array of rotor blades extending outwardly from the disk across the working medium flow path, and an inner air seal extending between the disks, the turbine section further having a stator assembly which includes a first outer air seal composed of an array of arcuate segments extending circumferentially about the first array of rotor blades and spaced radially from the first rotor blades leaving a radial gap $G_1$ therebetween, a second outer air seal composed of an array of arcuate segments extending circumferentially about the second array of rotor blades and spaced radially from the second rotor blades leaving a radial gap $G_2$ therebetween, an array of stator vanes each of which has an upstream end and a downstream end, the vanes extending axially between the first and second outer air seals and extending radially inwardly across the working medium flow path between the first and second arrays of rotor blades into proximity with the inner air seal leaving a radial gap $G_3$ therebetween, and means for supporting and positioning the outer air seals and vanes to regulate the gaps $G_1$, $G_2$ and $G_3$ which includes a coolable outer case extending circumferentially about the engine, the improvement which comprises:

a stator structure for supporting and positioning the outer air seals and vanes which includes first means for supporting the upstream end of the array of stator vanes and the first array of outer air seal segments which includes an upstream support ring formed of a plurality of upstream support segments which engage the segments of the outer air seal, which are circumferentially slidable with respect to the outer air seal and which trap the first seal segments in the axial direction, a downstream support ring formed of a plurality of downstream support segments which engage the outer air seal, which are circumferentially slidable with respect to the outer air seal and which trap the first seal segments in the axial direction, each of the downstream support segments being integral with the upstream end of the vane, a first flange attached to the outer case at a first location and extending inwardly from the outer case to radially attach and slidably engage in the circumferential direction the segments of at least one of the support rings and to radially attach the segments of both support rings to the outer case, second means for supporting the downstream end of the array of stator vanes and the second array of outer air seal segments which includes a downstream support ring formed of a plurality of downstream support segments which engage the segments of the outer air seal, which are circumferentially slidable with respect to the outer air seal and which trap the second seal segments in the axial direction, an upstream support ring formed of a plurality of upstream support segments which engage the outer air seal, which are circumferentially slidable with respect to the outer air seal and which trap the second seal segments in the axial direction, each of the upstream support segments being integral with the downstream end of the vane, a second flange attached to the outer case at a second location and extending inwardly from the outer case to radially attach and slidably engage in the circumferential direction the segments of at least one of the support rings and to radially attach the segments of both support rings to the outer case, a first coolable rail extending circumferentially about the exterior of the outer case for radially positioning the outer case at the first axial location, a first means for flowing cooling air to cool said first coolable rail, a second coolable rail extending circumferentially about the outer case for radially positioning the outer case at the first axial position, and a second means for flowing cooling air to cool said second coolable rail; wherein movement of the outer case inwardly in response to the flow of cooling air at the first coolable rail and the second coolable rail simultaneously adjusts the gap $G_1$, $G_2$, and $G_3$ between the stator assembly and the rotor assembly from two axial locations.

9. The stator structure as claimed in claim 8 wherein the first rail is at a first flanged casing joint, the second rail is at a second flanged casing joint, and an axially continuous casing extends between the first flanged joint and the second flanged joint which is uninterrupted by coolable rails.

10. The stator structure as claimed in claim 8 wherein a segment of the upstream support ring of the first support means is integral with a segment of the downstream support ring of the second support means.

* * * * *

UNITED STATES PATENT AND TRADEMARK OFFICE

CERTIFICATE OF CORRECTION

PATENT NO. : 4,553,901

DATED : November 19, 1985

INVENTOR(S) : Vincent P. Laurello

It is certified that error appears in the above-identified patent and that said Letters Patent is hereby corrected as shown below:

Column 3, line 29: after "A" change "principle" to "principal"

Column 3, line 34: after "Another" change "principle" to "principal"

Column 8, line 35: after "As" change "times" to "time"

Signed and Sealed this

Twenty-second Day of September, 1987

*Attest:*

DONALD J. QUIGG

*Attesting Officer* *Commissioner of Patents and Trademarks*